US010053844B2

(12) United States Patent
Huang

(10) Patent No.: US 10,053,844 B2
(45) Date of Patent: Aug. 21, 2018

(54) UNIVERSAL DRAIN PLUG

(71) Applicant: YU-HSIN PLASTIC CORP,.LTD, Xianxi Township, Changhua County (TW)

(72) Inventor: Pei-Hsiang Huang, Xianxi Township, Changhua County (TW)

(73) Assignee: YU-HSIN PLASTIC CORP LTD, Changhua County (TW)

( * ) Notice: Subject to any disclaimer, the term of this patent is extended or adjusted under 35 U.S.C. 154(b) by 328 days.

(21) Appl. No.: 14/864,856

(22) Filed: Sep. 24, 2015

(65) Prior Publication Data

US 2017/0089051 A1 Mar. 30, 2017

(51) Int. Cl.
*E03C 1/23* (2006.01)

(52) U.S. Cl.
CPC ..... *E03C 1/2302* (2013.01)

(58) Field of Classification Search
CPC ..... E03C 1/2302; E03C 1/23; E03C 1/2306
USPC ..... 4/295; 251/263
See application file for complete search history.

(56) References Cited

U.S. PATENT DOCUMENTS 3,333,815 A * 8/1967 Jones ..... E03C 1/23 251/230
3,428,295 A * 2/1969 Jones ..... F16K 31/528 251/144
5,881,397 A * 3/1999 Hobbs ..... A47K 1/14 251/297
8,701,224 B2 * 4/2014 Li ..... E03C 1/2306 4/287
9,151,027 B2 * 10/2015 Lucas ..... E03C 1/2302
2009/0271919 A1 * 11/2009 Scorvo ..... E03C 1/262 4/287
2014/0182053 A1 * 7/2014 Huang ..... A47K 1/14 4/286

FOREIGN PATENT DOCUMENTS

FR 1445742 A * 7/1966 ..... A47K 1/14

OTHER PUBLICATIONS

FR 1445742A Translation.*

* cited by examiner

*Primary Examiner* — Huyen Le
*Assistant Examiner* — William R Klotz

(57) ABSTRACT

A universal drain has a plug body, at least two sealing member and a pressing knob. The plug body is composed of a base, a movable member, a rotating member, a first spring and a cover.

4 Claims, 6 Drawing Sheets

UNIVERSAL DRAIN PLUG

BACKGROUND OF THE INVENTION

1. Field of the Invention

The present invention relates to a universal drain plug, and more particularly to a universal drain plug assembly for bathtubs.

2. Description of the Related Art

Conventional drains, as shown in FIG. 8, comprise a plug body 50 and a stopping member 60. The plug body 50 has a hollow space 51, the hollow space 51 is provided with a plurality of outlets 52 at its bottom and a screw hole 53 at its center. A sealing ring 54 is disposed above the plug body 50. The stopping member 60 has a cap 61, the cap 61 is provided with an enlarged portion 62, a flange 63 and a movable connecting bar 64. A threaded section 65 at an end of the connecting bar 64 engages with the screw hole 53 of the plug body 50, such that the stopping member 60 is secured onto the plug body 50. By moving the enlarged portion 62 to drive the connecting bar 64, the flange 63 of the cap 61 can open or close the hollow space 51.

However, the conventional structure described above, in the practical application, might happen following problems: the threaded section 65 can only match with the screw hole 53 having the same specification, so that conventional drain cannot use the same stopping member 60 for the different plug bodies 50. When the stopping member 60 is damaged, and wish to carry out maintenance and replacement, it is easy to buy the stopping member 60 having the threaded section 65 specification does not match the screw hole 53, and repair and replacement will be more difficult for user.

Therefore, it is desirable to provide a universal drain plug to mitigate and/or obviate the aforementioned problems.

SUMMARY OF THE INVENTION

An objective of the present invention is to provide a universal drain plug assembly.

In order to achieve the above mentioned objective, a universal drain plug assembly has a plug body, at least two sealing member and a pressing knob. The plug body is composed of a base, a movable member, a rotating member, a first spring and a cover.

The base is provided with a through aperture, the through aperture further has a limiting flange with a smaller diameter, a plurality of the grooves and a plurality of stopping ribs are alternatively disposed in the through aperture above the limiting flange.

The movable member and the rotating member both are placed into the through aperture of the base, a plurality of driving portions of the movable member and the stopping portions of the rotating member slide into the grooves of the base such that the movable member and the rotating member capable of moving along the stopping rib in the base; the movable member is further provided with a first thread column and a second thread column at its bottom end, the first thread column has a diameter larger than a diameter of the second thread column; at least one second spring is jacketed onto the movable member and between the limiting flange and the driving portion.

The cover has a plurality of claws; when the first spring is place in the through aperture of the base and pushes again the rotating member, the claws of the cover engage with the engaging aperture to mount the cover onto the base.

Each sealing member has an annular protrusion and an enlarged flange below the annular protrusion, each annular protrusion of the two sealing members has different heights; the annular protrusion is provided with a sleeve aperture, the sleeve aperture is jacketed onto the outer threaded section of the base, a lip provided above the sleeve aperture is placed onto the flange such that the sealing member is supported by the base of the plug body.

The pressing knob is provided with an assembly slot at its bottom, the assembly slot has an inner threaded section, and the inner threaded section engages with the outer threaded section of the base, such that the pressing knob is mounted onto the plug body and secures the sealing member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
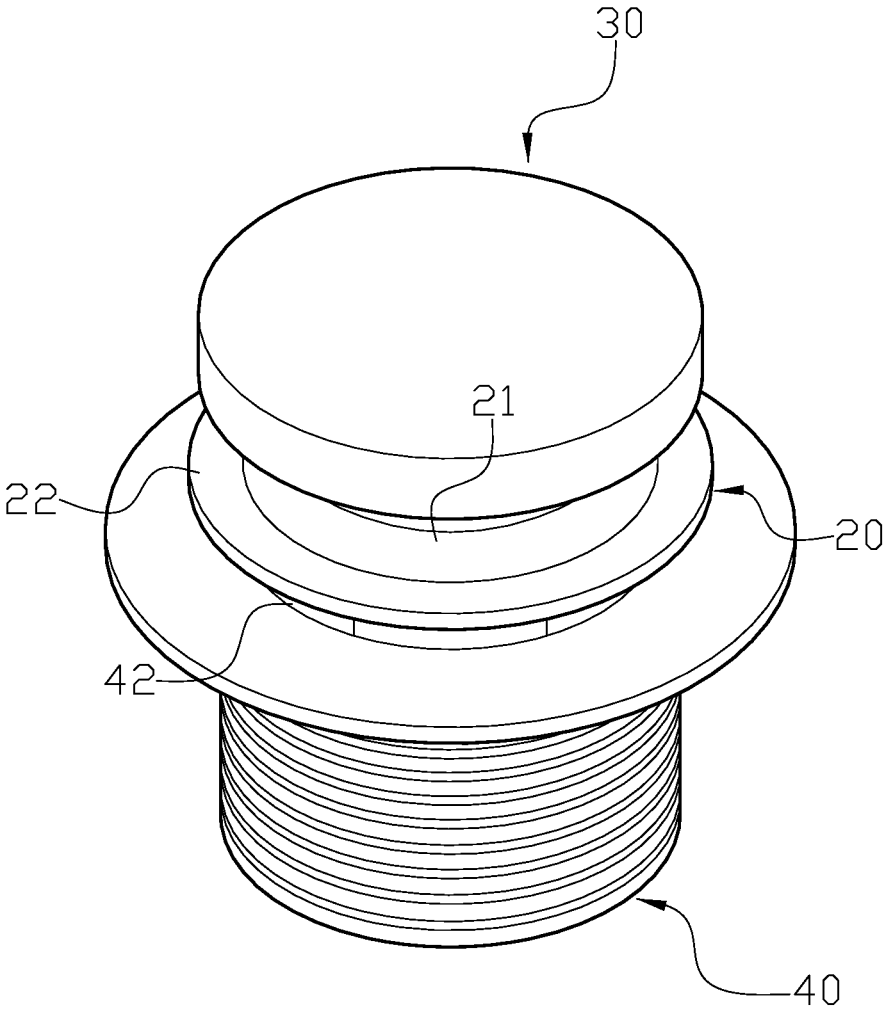
FIG. 1 is a perspective drawing of an embodiment of the present invention.
Figure 2:
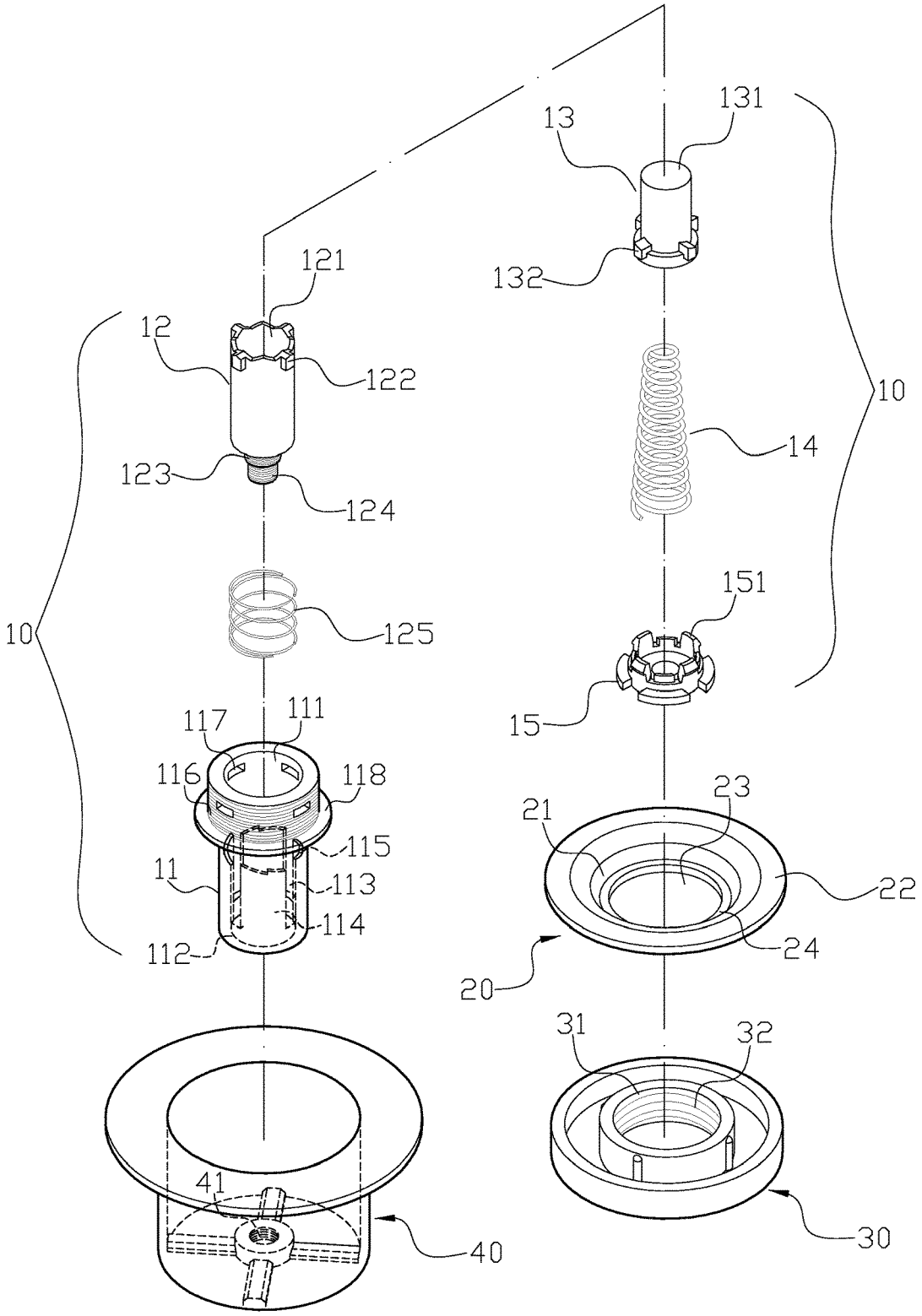
FIG. 2 is an exploded view of the embodiment of the present invention.
Figure 3:
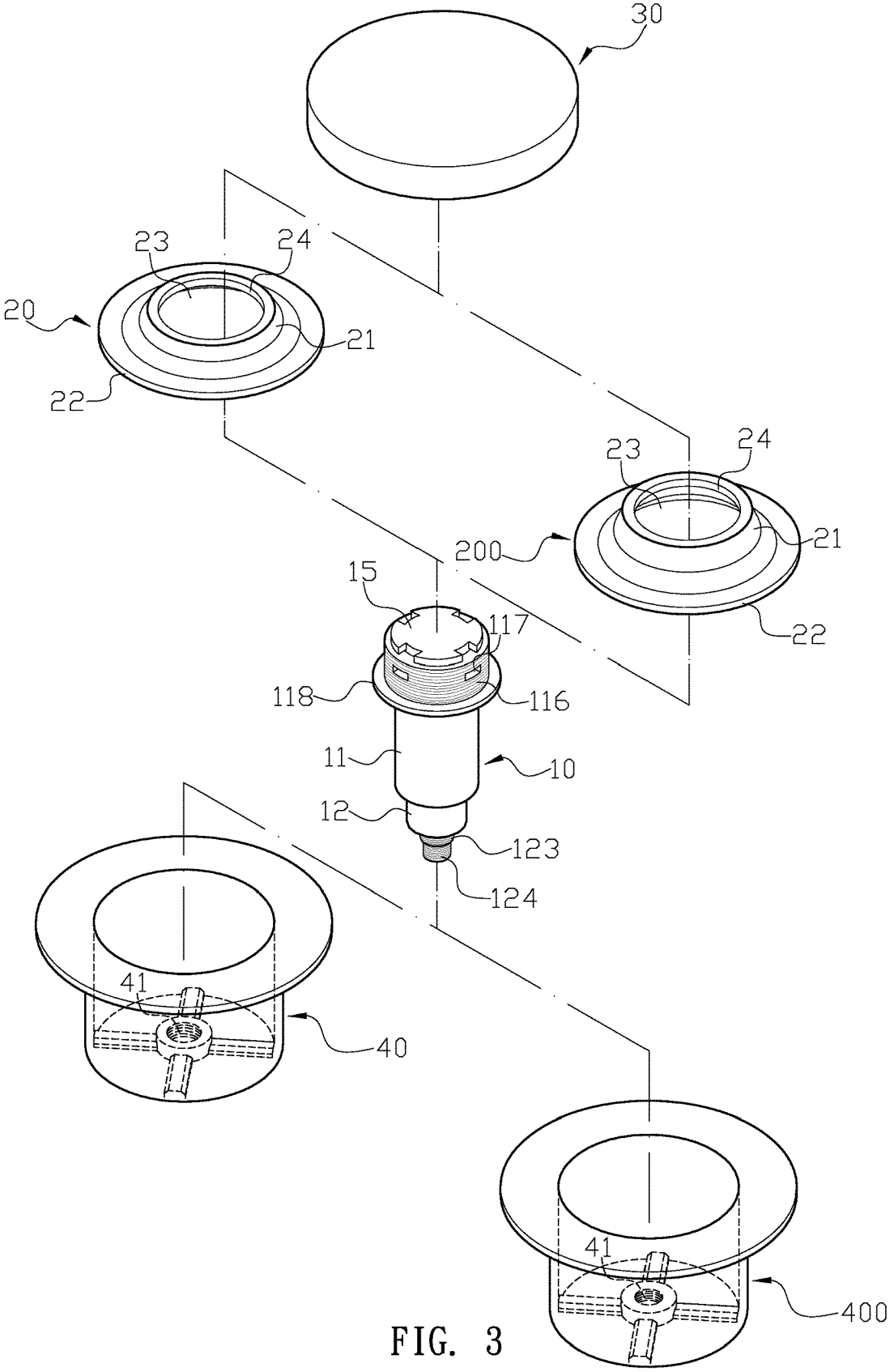
FIG. 3 is a schematic drawing of different plug bodies applying with the embodiment of the present invention.

First, please refer to FIG. 1 to FIG. 3. A universal drain comprises: a plug body 10, at least two sealing members 20, 200 and a pressing knob 30. The plug body 10 is composed of a base 11, a movable member 12, a rotating member 13, a first spring 14 and a cover 15. The base 11 is provided with a through aperture 111, the through aperture 111 further has a limiting flange 112 with a smaller diameter. A plurality of the grooves 113 and a plurality of stopping ribs 114 are alternatively disposed in the through aperture 111 above the limiting flange 112. Each stopping rib 114 is provided with a stopping portion 115 at its top end, and the stopping portion 115 has a stepped-shape. An outer threaded section 116 with a plurality of engaging apertures 117 is disposed above the base 11, and a flange 118 is disposed below the outer threaded section 116. A sleeve aperture 121 and a guiding column 131 are correspondingly and respectively disposed on the movable member 12 and the rotating member 13, the guiding column 131 of the rotating member 13 is inserted into the sleeve aperture 121 of the movable member 12, and then the movable member 12 and the rotating member 13 are placed into the through aperture 111 of the base 11 together. A plurality of driving portions 122 of the movable member 12 and the stopping portions 132 of the rotating member 13 slide into the grooves 113 of the base 11 such that the movable member 12 and the rotating member 13 capable of moving along the stopping rib 114 in the base 11. The movable member 12 is further provided with a first thread column 123 and a second thread column 124 at its bottom end, the first thread column 123 has a diameter larger than a diameter of the second thread column 124. Furthermore, at least one second spring 125 is jacketed onto the movable member 12 and between the limiting flange 112 and the driving portion 122. The cover 15 has a plurality of claws 151. when the first spring 14 is place in the through aperture 111 of the base 11 and pushes again the rotating member 13, the claws 151 of the cover 15 engage with the engaging aperture 117 to mount the cover 15 onto the base 11. Therefore, the movable member 12, the rotating member 13, and the first spring 14 will not fall out. The sealing member 20, 200 has a bowl shape. Each sealing member 20, 200 has an annular protrusion 21 and an enlarged flange 22 below the annular protrusion 21, and each annular protrusion 21 of the two sealing members 20, 200 has different heights suitable for different drain 40, 400. The annular protrusion 21 is provided with a sleeve aperture 23, the sleeve aperture 23 is jacketed onto the outer threaded section 116 of the base 11. A lip 24 is provided above the sleeve aperture 23 is placed onto the flange 118 such that the sealing member 20, 200 is supported by the base 11 of the plug body 10. Furthermore, the pressing knob 30 is provided with an assembly slot 31 at its bottom, the assembly slot 31 has an inner threaded section 32, the inner threaded section 32 engages with the outer threaded section 116 of the base 11, such that the pressing knob 30 is mounted onto the plug body 10 and secures the sealing member 20, 200.

Figure 4:
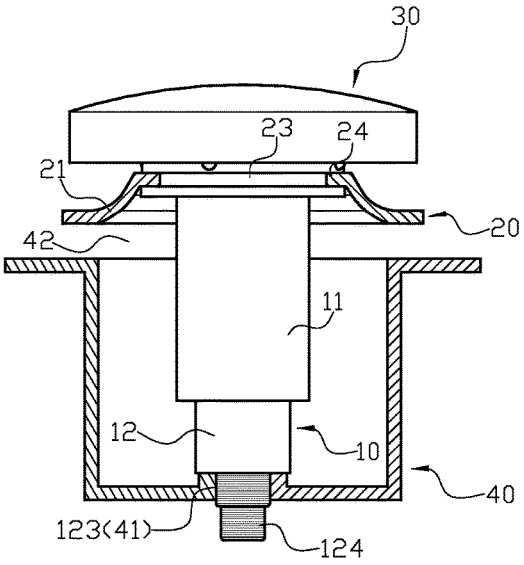
FIG. 4 shows the plug body being opened according to the plug body the embodiment of the present invention.
Figure 6:
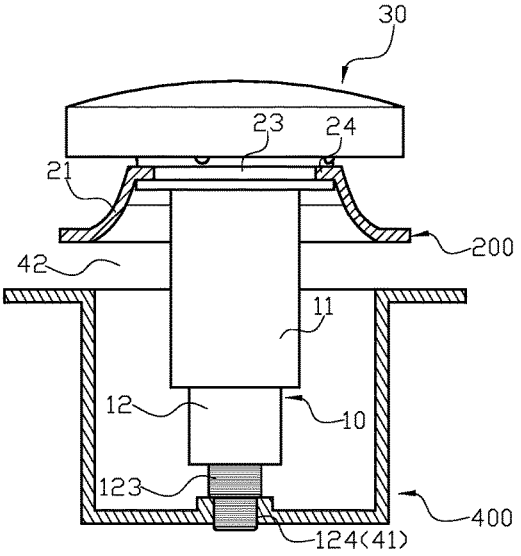
FIG. 6 shows the plug body being opened according to another plug body the embodiment of the present invention.

In the embodiment of the present invention, the movable member 12 has the first thread column 123 and the second thread column 124 respectively for the sealing members 20, 200 to be suitable for the drains 40, 400. For example, the drain 40 has the most common specification, the first thread column 123 of the movable member 12 extends out from the through aperture 111 of the base 11 and engages with the screw hole 41 of the drain 40, such that the sealing member 20 and the pressing knob 30 are mounted onto the drain 40 via the plug body 10, as shown in FIG. 4. Furthermore, with the dimension difference between the first thread column 123 and the second thread column 124 are respectively suitable for the screw holes 41 for the drain 40, 400. For example, the second thread column 124 is capable of engaging with the smaller screw hole 41 of the drain 400, as shown in FIG. 6. In addition, the first thread column 123 and the second thread column 124 provide height difference for the plug body 10 in the drain 40, 400 such that the annular outlets 42 between the pressing knob 30 and the drain 40, 400 will be different. While rotating the pressing knob 30 to open, the annular protrusion 21 of the sealing member 20, 200 can be changed to match the annular outlet 42 such that after the pressing knob 30 is pressed down, the sealing member 20, 200 can seal the annular outlet 42.

Figure 5:
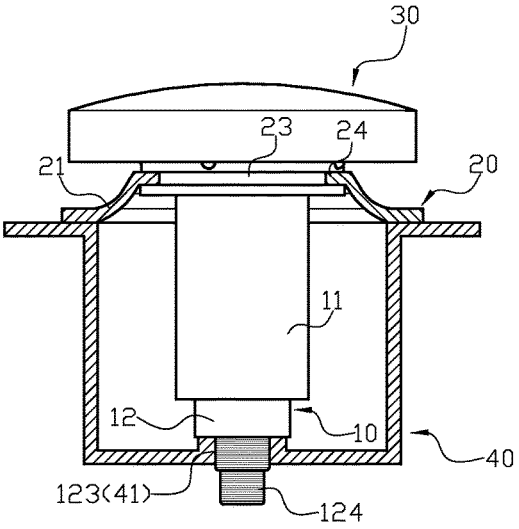
FIG. 5 shows the plug body being closed according to the plug body the embodiment of the present invention.
Figure 7:
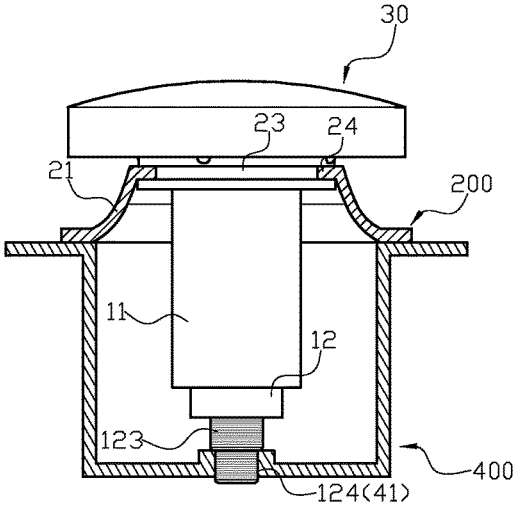
FIG. 7: shows the plug body being closed according to another plug body the embodiment of the present invention.
Figure 8:
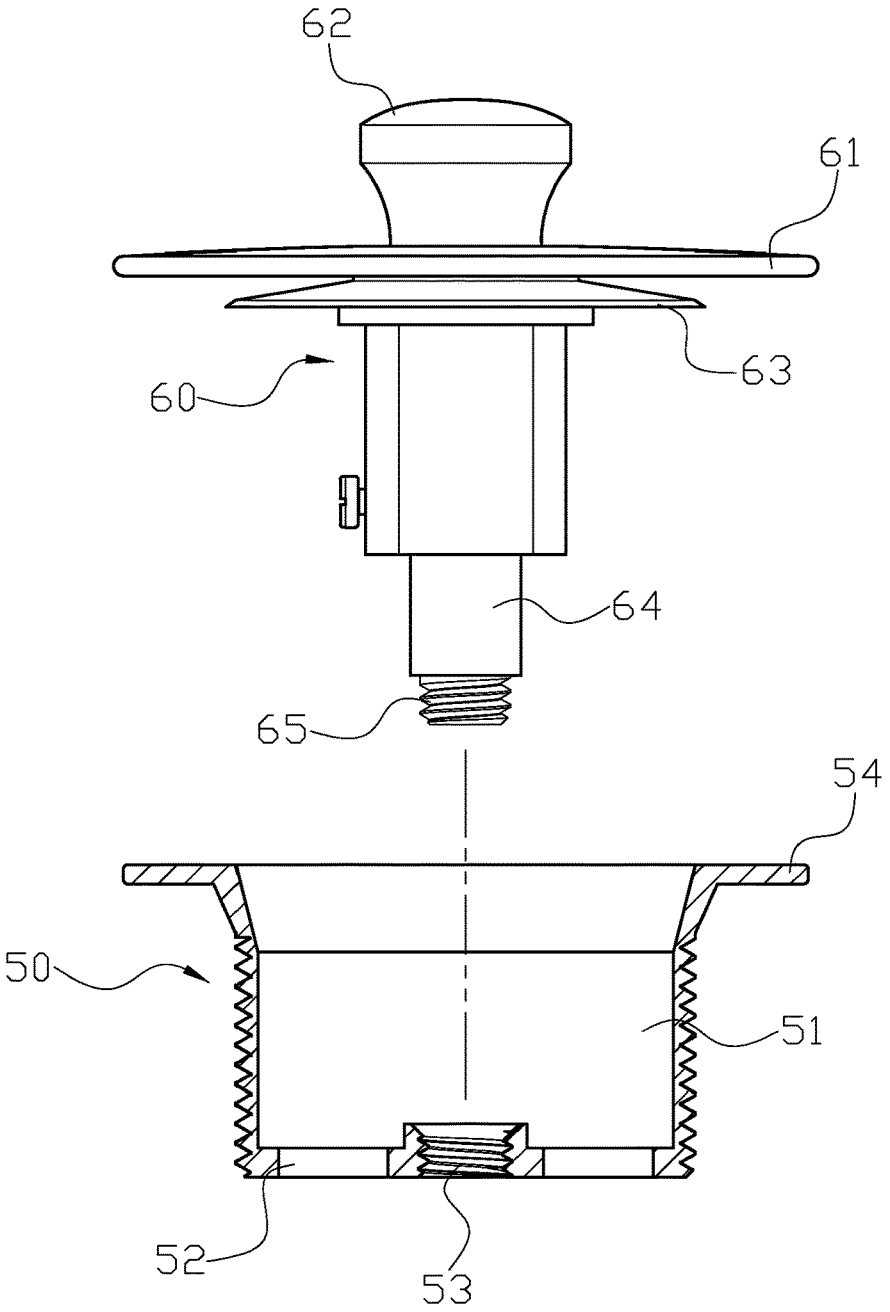
FIG. 8 PRIOR ART
FIG. 8 is a structure drawing of a prior art.

When the pressing knob 30 is pressed down, the movable member 12 pushes the rotating member 13 upwardly, the stopping portion 132 of the rotating member 13 moves above the stopping rib 114, the driving portion 122 drives the rotating member 13 to make the stopping portion 132 to engage with the stopping portion 115 of the base 11. Therefore, the rotating member 13 is free from the first spring 14, with the tension provided by the second spring 125, the pressing knob 30 and the sealing member 20, 200 can be maintain at a lower position to block the annular outlet 42 of the drain 40, 400, as shown in FIG. 5 and FIG. 7. Alternatively, in order to start draining, pressing down the pressing knob 30, the movable member 12 moves upwardly and drives the stopping portion 132 of to escape from the stopping portion 115, such that the rotating member 13 is pushed by the first spring 14, pushes down the movable member 12 to compress the second spring 125. Therefore, the pressing knob 30 and the sealing member 20, 200 move away from the annular outlet 42, as shown in FIG. 4 and FIG. 6.

With the above mentioned structure, following benefits can be obtained: 1. the screw hole 41 or the annular outlet 42 of the drain 40, 400 can be suitable for most of typical plug bodies. 2. Different combination of the sealing member 20, 200 and drain 40, 400 can provide multiple options for the user.

Although the present invention has been explained in relation to its preferred embodiment, it is to be understood that many other possible modifications and variations can be made without departing from the spirit and scope of the invention as hereinafter claimed.

What is claimed is:

1. A universal drain plug assembly comprising:

a plug body, at least two sealing members, and a pressing knob, the plug body including a base comprising an outer threaded section, a movable member comprising a plurality of driving portions extending from the movable member, a rotating member comprising a plurality of stopping portions extending out from the rotating member, a first spring and a cover, wherein a through aperture extends through the base, the through aperture including a limiting flange opposite the outer threaded section and radially extending into the through aperture, and wherein a plurality of grooves and a plurality of stopping ribs are alternatively disposed in the through aperture above the limiting flange;

the movable member and the rotating member both are disposed in the through aperture of the base, the plurality of driving portions of the movable member and the stopping portions of the rotating member configured to slide in the grooves of the base such that the movable member and the rotating member are movable along the stopping ribs in the base;

the movable member further comprises a first thread column and a second thread column at a bottom end of the movable member, the first thread column having a diameter larger than a diameter of the second thread column;

wherein at least one second spring is jacketed onto the movable member and disposed between the limiting flange and the driving portions;

the cover comprises a plurality of claws, and the outer threaded section of the base includes a plurality of engaging apertures, and the base further includes an engaging flange extending from the base below the outer threaded section; wherein the first spring is disposed in the through aperture of the base to push against the rotating member, and the claws of the cover engage with the engaging apertures to mount the cover onto the base;

each sealing member comprises an annular protrusion and a flange below the annular protrusion and extending from the annular protrusion, each annular protrusion of the two sealing members having different heights;

wherein each annular protrusion is provided with a sleeve aperture, the sleeve aperture configured to be jacketed onto the outer threaded section of the base, and a lip is provided above the sleeve aperture to abut against the engaging flange of the base such that the sealing member is supported by the base of the plug body; and the pressing knob comprises an assembly slot at bottom at a bottom of the pressing knob, the assembly slot includes an inner threaded section, the inner threaded section engages with the outer threaded section of the base, such that the pressing knob is mounted onto the plug body and secures the sealing member.

2. The universal drain plug assembly as claimed in claim 1, wherein a top portion of each stopping rib has a stepped-shape.

3. The universal drain plug assembly as claimed in claim 1, wherein the movable member comprises a sleeve aperture, and the rotating member comprises a guiding column, the guiding column of the rotating member inserted into the sleeve aperture of the movable member, and the movable member with the rotating member are placed into the through aperture of the base.

4. The universal drain plug assembly as claimed in claim 1, wherein the sealing member is concave.

* * * * *